United States Patent [19]

Belvederi

[11] Patent Number: 4,777,966

[45] Date of Patent: Oct. 18, 1988

[54] MANUFACTURING MACHINE FOR PRODUCING CIGARETTES COMPOSED OF TOBACCO PORTIONS HAVING DIFFERENT CHARACTERISTICS

[75] Inventor: Bruno Belvederi, San Martino di Monte S. Pietro, Italy

[73] Assignee: G.D. Societa per Azioni, Bologna, Italy

[21] Appl. No.: 927,928

[22] Filed: Nov. 6, 1986

[30] Foreign Application Priority Data

Dec. 20, 1985 [IT] Italy ..... 3653 A/85

[51] Int. Cl.[4] ..... A24B 15/18; A24C 5/14

[52] U.S. Cl. ..... 131/79; 131/31; 131/62; 131/84.1; 131/290; 131/63

[58] Field of Search ..... 131/84.1, 84.3, 84.4, 131/31, 62, 63, 79, 290

[56] References Cited

U.S. PATENT DOCUMENTS 4,488,562 12/1984 Remington ..... 131/31

FOREIGN PATENT DOCUMENTS 0953792 4/1964 United Kingdom ..... 131/31

*Primary Examiner*—V. Millin

*Attorney, Agent, or Firm*—Ladas & Parry

[57] ABSTRACT

A cigarette manufacturing machine, comprising an ascending shaft arranged to feed a tobacco mixture into a belt conveyor in such a manner as to form thereon a substantially continuous tobacco layer, a trimmer device arranged to reduce and regularize the thickness of the tobacco layer, a cyclically operating heater device arranged to successively heat determined portions of the tobacco layer, a section for wrapping the tobacco layer in paper to produce a continuous cigarette rod, and a cutter device operating cyclically in determined phase relationship with the heater device to cut the continuous cigarette rod.

10 Claims, 2 Drawing Sheets

MANUFACTURING MACHINE FOR PRODUCING CIGARETTES COMPOSED OF TOBACCO PORTIONS HAVING DIFFERENT CHARACTERISTICS

BACKGROUND OF THE INVENTION

1. Field of Invention

This invention relates to a manufacturing machine for producing cigarettes composed of tobacco portions having different characteristics.

2. Description of Related Art

It is well known that the use of a single tobacco mixture for producing cigarettes can lead to certain drawbacks in that, for example, in a cigarette that tobacco portion furthest from the lit end behaves as a filter during cigarette combustion, and retains the combustion products to give the final part of the cigarette a taste which gradually differs from that of the initial part.

In order to adjust the aforesaid characteristics at will, it has been proposed to manufacture cigarettes using several tobacco mixtures located in different cigarette zones so that the said characteristics become influenced in a required and determined manner during the cigarette combustion time.

To obtain cigarettes of this type, manufacturing machines have been proposed in which two ascending shafts disposed one following the other successively feed a suction belt conveyor with two continuous layers of tobacco of different type. At the outlet of the first shaft, a trimmer device removes equidistant tobacco portions from the first layer to create spaces which are then filled with tobacco of the second type by the second shaft.

A second trimmer device disposed downstream of the second shaft along the path of said conveyor makes the thickness of the overall tobacco layer obtained uniform.

A drawback of manufacturing machines of this type is that the two said trimmer devices trim away a large quantity of tobacco, which is known to result in considerable quality loss.

A further drawback of such manufacturing machines is their considerable structural complexity due to the presence of the two shafts and the two trimmer devices, and their considerable overall size due to the presence of the two said consecutive ascending shafts.

SUMMARY OF THE INVENTION

The object of the present invention is to provide a manufacturing machine for producing cigarettes composed of tobacco portions having different characteristics, which does not give rise to the described drawbacks of the known art.

The said object is attained according to the present invention by a manufacturing machine for producing cigarettes composed of tobacco portions having different characteristics, comprising a substantially vertical shaft for feeding from the bottom upwards a continuous stream of tobacco particles, a suction conveyor, overlying said shaft, for the formation and transfer of a continuous layer of tobacco particles, a trimmer device for said layer arranged to reduce its thickness, a section for wrapping said layer in paper and fed with said tobacco layer by said suction conveyor, in order to form a continuous cigarette rod, and a device for cutting said cigarette rod into cigarette pieces, characterised by comprising a cyclically operated heater device operating in fixed phase relationship with said cutter device in order to heat equidistant portions of said tobacco layer.

The invention is described hreinafter by way of non-limiting example with reference to the accompanying drawings in which:

DESCRIPTION OF THE PREFERRED EMBODIMENTS

Figure 1:
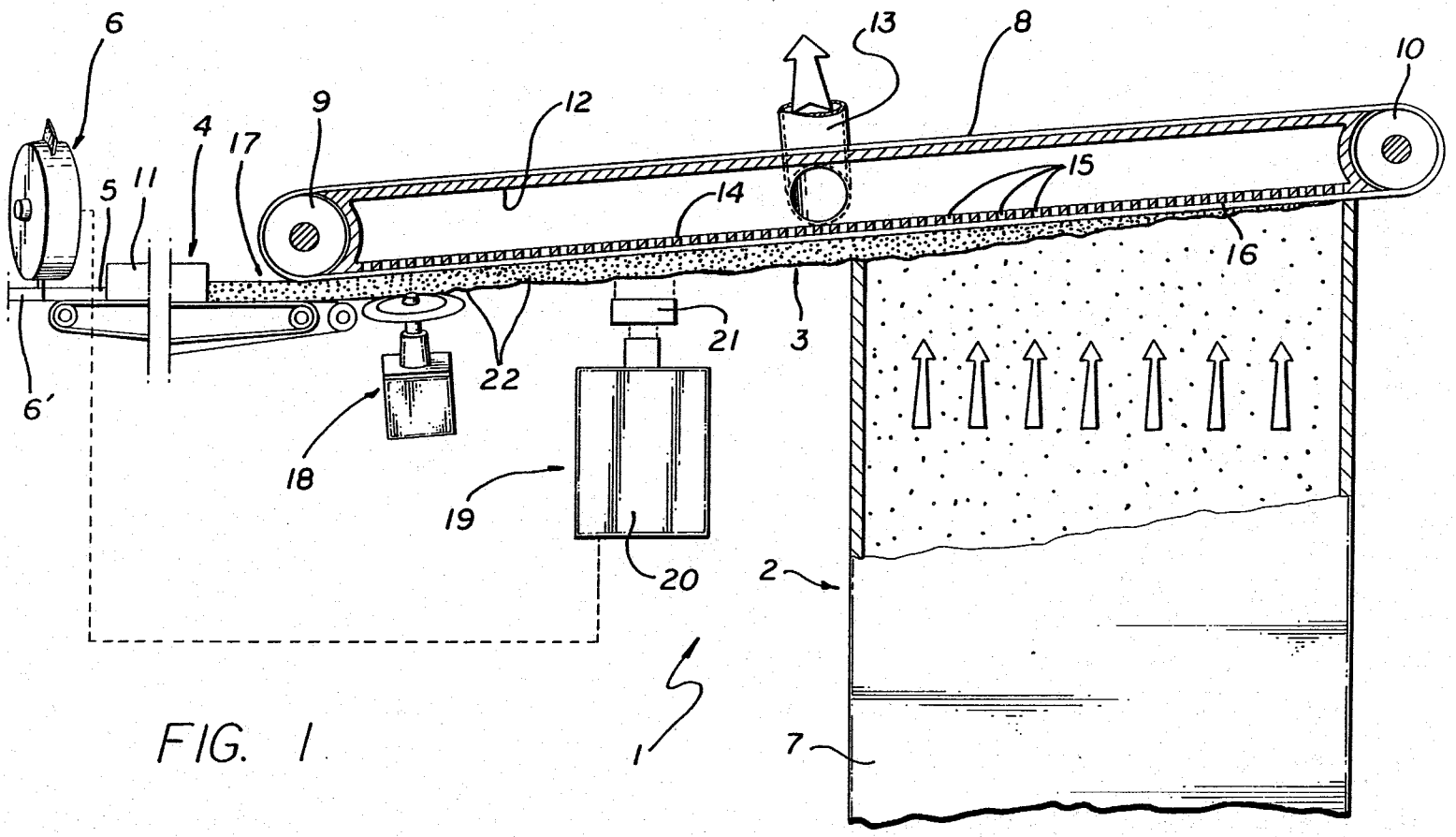
FIG. 1 is a diagrammatic front view of a cigarette manufacturing machine constructed in accordance with the present invention.
Figure 2:
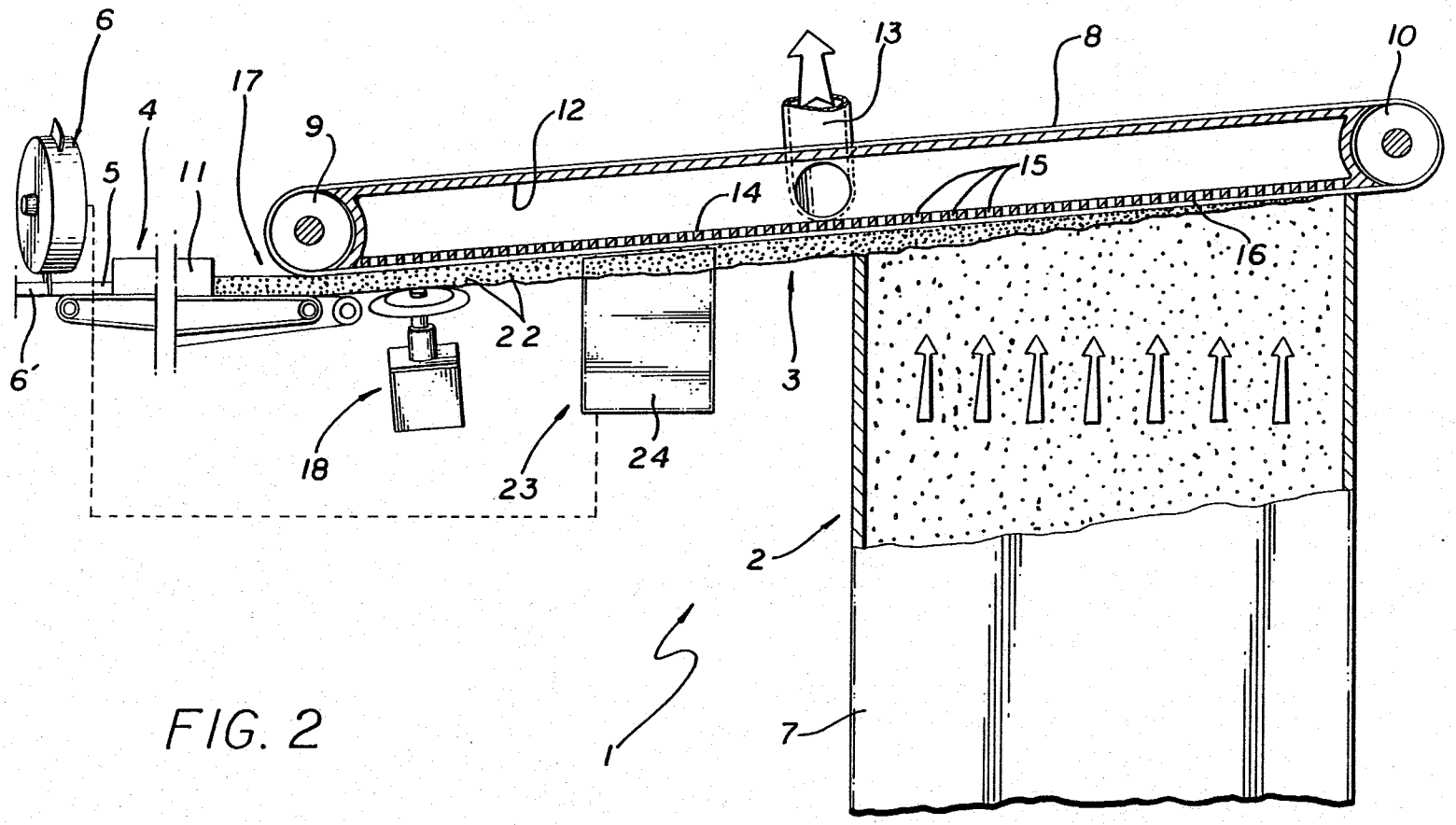
FIG. 2 is a diagrammatic front view of a second embodiment of the cigarette manufacturing machine according to the present invention.

In FIGS. 1 and 2, the reference numeral 1 indicates overall a cigarette manufacturing machine of the continuous rod type.

The machine 1 comprises a section 2 for forming a tobacco layer 3, and a section 4 for wrapping said layer 3 in paper in order to form a continuous cigarette rod 5 to be cut by a cutter device 6 to form cigarette pieces 6' of length double that of a finished cigarette.

The section 2 comprises an ascending shaft 7 above which there is a suction belt conveyor 8 passing about clockwise-rotating end rollers 9 and 10.

The left hand end of the conveyor 8 with reference to FIGS. 1 and 2 is positioned close to a device 11 for forming the cigarette rod 5 and constituting part of the section 4.

Within the loop defined by the belt conveyor 8 there is provided a chamber 12, which is connected by a pipe 13 to a suction source, not shown, and is defined lowerly by a wall 14 which is permeable to air over its entire surface by being provided with a plurality of perforations 15.

The lower branch 16 of the conveyor 8, which slides in contact with the wall 14, closes the upper end of the shaft 7, its left hand end extending to a position 17, defined as the loading position, at which the conveyor 8 feeds the tobacco layer 3 to the forming device 11.

In proximity to the branch 16, downstream of the shaft 7 with reference to the direction of movement of the layer 3 and upstream of the loading position 17, there is provided a trimmer device 18 of known type able to reduce and make uniform the thickness of the layer 3 retained by suction by the branch 16. As shown in FIG. 1, between the shaft 7 and trimmer device 18 the tobacco layer 3 is subjected to the action of a cyclically operated heater device 19 consisting of a laser source 20 able to direct a laser beam through a cylindrical lens 21 and towards the layer 3 in order to heat successive tobacco portions 22 spaced apart by equal distances of determined length. The distance between the intermediate zones between two consecutive portions 22 is equal to the length of the cigarette pieces 6'.

When the machine 1 is operating, means of known type, not shown, feed a continuous stream of tobacco particles to the lower end of the shaft 7.

These particles, under the thrust of an ascending air stream generated by the suction source connected to the chamber 12, rise through the shaft 7 to adhere to the branch 16, forming by accumulation a continuous tobacco layer of substantially uniform thickness.

The heater device 19 then heats the said tobacco portions 22, to modify their organoleptic characteristics. In this respect, it is known that the taste of the tobacco can be modified by heating it, and in particular a tobacco which has been strongly heated has a "stronger" taste for the smoker than a tobacco which has not undergone heat treatment.

Downstream of the heater device 19, the trimmer device 18 then regularises the thickness of the layer 3, which in the said loading position 17 is discharged by the conveyor 8 onto the forming device 11 to be wrapped in known manner in a paper web. The continuous cigarette rod 5 thus obtained is then cut in the central zones of the portions 22 by the cutter device 6.

The cigarette pieces 6' obtained in the described manner contain at their ends a tobacco having different characteristics from those of the tobacco contained in their intermediate zone. Downstream of the manufacturing machine 1, the pieces 6' are then cut in their intermediate zones to form cigarettes containing two tobacco portions of different characteristics located in different cigarette zones.

In a non-illustrated embodiment of the manufacturing machine according to the present invention, the tobacco layer 3 could also be exposed on its lateral surfaces to laser beams emitted by the source 20.

In a further embodiment of the manufacturing machine 1 shown in FIG. 2, the heater device 19 can be replaced by a heater device 23 comprising a microwave generator unit 24 able to cyclically act on determined portions of the tobacco layer 3 in order to heat them. Thus again in this case, by virtue of the unit 24, the layer 3 which reaches the trimmer device 18 comprises equidistant tobacco portions 22 having different characteristics from those of the tobacco fed to the conveyor 8 by the shaft 7. In further non-illustrated embodiments of the present invention, the heater devices 19 and 23 could be disposed downstream of the trimmer device 18 in such a manner as to act on a tobacco layer 3 which has already been trimmed.

Finally, the microwave heater device 23 could also be disposed along the path followed by the cigarette rod 5, ie between the section 4 and the cutter device 6, so as to heat determined equidistant portions which have already been wrapped in a paper web.

I claim:

1. A manufacturing machine for producing cigarettes containing sections of tobacco having differing characteristics, said machine comprising:

a substantially vertical shaft having a bottom and a top end, tobacco being continuously fed into said bottom end;

a continuous conveyor associated with and overlying said top end of said shaft;

suction means associated with said conveyor to draw the tobacco held in said shaft against said conveyor;

a trimmer arranged near said conveyor and said shaft, said trimmer acting to level-off the tobacco layer held against said conveyor by said suction means as said conveyor moves away from said top end of said shaft;

wrapping means for receiving the tobacco layer carried by said conveyor subsequent to its being trimmed, and wrapping said tobacco layer in paper to form a continuous cigarette rod;

cutting means associated with said wrapping means for cutting said cigarette rod into cigarette pieces; and cyclical heating means for heating and thus modifying the taste characteristics of selected portions of said tobacco layer after said tobacco layer has been carried away from said shaft by said conveyor said tobacco layer being cut into cigarette pieces which contain at least one portion of tobacco having one taste characteristic and at least a second portion of tobacco having a second taste characteristic.

2. A manufacturing machine as claimed in claim 1, wherein said cyclical means comprises a pulsed laser source arranged to direct a laser beam onto determined portions of said tobacco layer.

3. A manufacturing machine as claimed in claim 2, wherein said cyclical means is disposed, with reference to the direction of the movement of said tobacco layer, between said shaft and said trimmer.

4. A manufacturing machine as claimed in claim 2, wherein said cyclical heating means is disposed with reference to the direction of movement of said tobacco layer, between said trimmer and said wrapping means.

5. A manufacturing machine as claimed in claim 1, wherein said cyclical heating means comprises a micro wave generator unit.

6. A manufacturing machine as claimed in claim 5, wherein said cyclical heating means is disposed between said wrapping means and said cutting means.

7. A manufacturing machine as claimed in claim 5, wherein said cyclical heating means is disposed, with reference to the direction of the movement of said tobacco layer, between said shaft and said trimmer.

8. A manufacturing machine as claimed in claim 5, wherein said cyclical heating means is disposed, with reference to the direction of movement of said tobacco layer, between said trimmer and said wrapping means.

9. A manufacturing machine as claimed in claim 1, wherein said cyclical heating means is disposed, with reference to the direction of the movement of said tobacco layer, between said shaft and said trimmer.

10. A manufacturing machine as claimed in claim 1, wherein said cyclical heating means is disposed, with reference to the direction of movement of said tobacco layer, between said trimmer and said wrapping means.

* * * * *